US008448368B2

(12) United States Patent
Cabahug et al.

(10) Patent No.: US 8,448,368 B2
(45) Date of Patent: May 28, 2013

(54) RIFLE ACCESSORY RAIL, COMMUNICATION, AND POWER TRANSFER SYSTEM—RAIL CONTACTS

(75) Inventors: Eric F. Cabahug, Fairfax, VA (US); James S. Dodd, Linden, VA (US); Hector Tapia, Ashburn, VA (US); John Schroeder, Leesburg, VA (US); Jay Tilton, Leesburg, VA (US); Don McLaughlin, Ashburn, VA (US); Ben Feldman, Reston, VA (US)

(73) Assignee: Prototype Productions Incorporated Ventures Two, LLC, Ashburn, VA (US)

( * ) Notice: Subject to any disclaimer, the term of this patent is extended or adjusted under 35 U.S.C. 154(b) by 102 days.

(21) Appl. No.: 12/689,440

(22) Filed: Jan. 19, 2010

(65) Prior Publication Data

US 2010/0192444 A1 Aug. 5, 2010

Related U.S. Application Data

(60) Provisional application No. 61/145,222, filed on Jan. 16, 2009.

(51) Int. Cl.
*F41C 23/00* (2006.01)

(52) U.S. Cl.
USPC ..... 42/85; 42/71.01; 42/72; 42/84; 42/75.03

(58) Field of Classification Search
USPC ..... 42/85, 71.01, 72, 84, 75.03
See application file for complete search history.

(56) References Cited

U.S. PATENT DOCUMENTS

| | | | | |
|---|---|---|---|---|
| 4,533,980 | A | 8/1985 | Hayes | |
| 5,033,219 | A * | 7/1991 | Johnson et al. | 42/115 |
| 5,142,806 | A | 9/1992 | Swan | |
| 5,360,949 | A | 11/1994 | Duxbury | |
| 5,669,174 | A | 9/1997 | Teetzel | |
| 5,822,905 | A | 10/1998 | Teetzel | |
| 5,826,363 | A | 10/1998 | Olson | |
| 6,237,271 | B1 | 5/2001 | Kaminski | |
| 6,618,976 | B1 | 9/2003 | Swan | |
| 6,622,416 | B2 | 9/2003 | Kim | |
| 6,925,744 | B2 | 8/2005 | Kincel | |
| 6,931,775 | B2 | 8/2005 | Burnett | |
| 7,144,830 | B2 | 12/2006 | Hill et al. | |
| 7,243,454 | B1 * | 7/2007 | Cahill | 42/72 |
| RE40,216 | E | 4/2008 | Swan | |
| 7,421,818 | B2 | 9/2008 | Houde-Walter | |
| 7,464,495 | B2 * | 12/2008 | Cahill | 42/72 |
| 7,525,203 | B1 | 4/2009 | Racho | |
| 7,548,697 | B2 | 6/2009 | Hudson et al. | |
| 7,559,169 | B2 | 7/2009 | Hung et al. | |
| 7,562,483 | B2 * | 7/2009 | Hines | 42/90 |
| 7,584,569 | B2 | 9/2009 | Kallio et al. | |

(Continued)

OTHER PUBLICATIONS

In the US Patent and Trademark Office U.S. Appl. No. 12/689,430 Non-Final Office Action dated Feb. 17, 2011, 4 pages.

(Continued)

*Primary Examiner* — Michelle Clement
(74) *Attorney, Agent, or Firm* — Patton Boggs LLP

(57) ABSTRACT

The present invention is related to weapons systems. In particular, the present invention is directed to accessory attachment systems for rifles and small arms weapons that enable attached accessory devices to draw power from a central power source and communicate with the user and/or other devices.

6 Claims, 23 Drawing Sheets

U.S. PATENT DOCUMENTS

| | | | | |
|---|---|---|---|---|
| 7,627,975 | B1 | 12/2009 | Hines | |
| 7,640,690 | B2 * | 1/2010 | Hines | 42/75.03 |
| 7,676,975 | B2 * | 3/2010 | Phillips et al. | 42/72 |
| 7,712,241 | B2 | 5/2010 | Teetzel et al. | |
| 7,818,910 | B2 * | 10/2010 | Young | 42/71.01 |
| 7,841,120 | B2 | 11/2010 | Teetzel et al. | |
| 7,866,083 | B2 | 1/2011 | Teetzel | |
| 7,975,419 | B2 * | 7/2011 | Darian | 42/84 |
| 8,001,715 | B2 | 8/2011 | Stokes | |
| 8,091,265 | B1 | 1/2012 | Teetzel et al. | |
| 2005/0241206 | A1 | 11/2005 | Teetzel et al. | |
| 2008/0010890 | A1 | 1/2008 | Vice et al. | |
| 2008/0040965 | A1 | 2/2008 | Solinsky et al. | |
| 2008/0063400 | A1 | 3/2008 | Hudson et al. | |
| 2008/0134562 | A1 | 6/2008 | Teetzel | |
| 2008/0170838 | A1 * | 7/2008 | Teetzel et al. | 386/118 |
| 2008/0190002 | A1 * | 8/2008 | Hines | 42/1.06 |
| 2009/0044439 | A1 * | 2/2009 | Phillips et al. | 42/72 |
| 2009/0108589 | A1 * | 4/2009 | Racho | 290/1 R |
| 2009/0255160 | A1 * | 10/2009 | Summers | 42/70.01 |
| 2010/0031552 | A1 | 2/2010 | Houde-Walter | |
| 2010/0083553 | A1 | 4/2010 | Montgomery | |
| 2010/0192443 | A1 | 8/2010 | Cabahug et al. | |
| 2010/0192444 | A1 | 8/2010 | Cabahug et al. | |
| 2010/0192446 | A1 | 8/2010 | Darian | |
| 2010/0192448 | A1 | 8/2010 | Darian | |
| 2010/0218410 | A1 | 9/2010 | Cabahug et al. | |
| 2010/0242332 | A1 | 9/2010 | Teetzel et al. | |
| 2011/0000120 | A1 | 1/2011 | Thompson | |
| 2011/0010979 | A1 | 1/2011 | Houde-Walter | |
| 2011/0126622 | A1 | 6/2011 | Turner | |
| 2011/0162251 | A1 * | 7/2011 | Houde-Walter | 42/146 |
| 2011/0173865 | A1 | 7/2011 | Compton et al. | |

OTHER PUBLICATIONS

Third Party Submission by Michael B. Brooks dated May 12, 2011.
In the US Patent and Trademark Office U.S. Appl. No. 12/689,436 Non-Final Office Action dated Oct. 5, 2011, 4 pages.
In the US Patent and Trademark Office U.S. Appl. No. 12/689,437 Non-Final Office Action dated Oct. 6, 2011, 10 pages.
In the US Patent and Trademark Office U.S. Appl. No. 12/689,438 Non-Final Office Action dated Oct. 11, 2011, 9 pages.
In the US Patent and Trademark Office U.S. Appl. No. 12/791,460 Non-Final Office Action dated Oct. 6, 2011, 6 pages.
In the US Patent and Trademark Office U.S. Appl. No. 12/950,979 Non-Final Office Action dated Oct. 5, 2011, 11 pages.
In the US Patent and Trademark Office U.S. Appl. No. 13/075,837 Non-Final Office Action dated Dec. 20, 2011, 8 pages.
In the US Patent and Trademark Office U.S. Appl. No. 13/075,857 Non-Final Office Action dated Jan. 11, 2012, 10 pages.
In the US Patent and Trademark Office U.S. Appl. No. 13/075,880 Non-Final Office Action dated Dec. 22, 2011, 11 pages.
In the US Patent and Trademark Office Application U.S. Appl. No. 12/689,438 Final Office Action dated Jul. 19, 2012, 9 pages.
In the US Patent and Trademark Office Application U.S. Appl. No. 13/075,837 Final Office Action dated Jul. 12, 2012, 5 pages.
In the US Patent and Trademark Office Application U.S. Appl. No. 13/075,837 Non-Final Office Action dated Dec. 26, 2012, 3 pages.
In the US Patent and Trademark Office Application U.S. Appl. No. 13/075,857 Final Office Action dated Jul. 19, 2012, 13 pages.
In the US Patent and Trademark Office Application U.S. Appl. No. 13/075,880 Final Office Action dated Mar. 29, 2012, 12 pages.
In the US Patent and Trademark Office Application U.S. Appl. No. 13/370,629 Non-Final Office Action dated Mar. 29, 2012, 7 pages.

* cited by examiner

Open Position Switch Contacts

Closed Position Switch Contacts

Open Position Shrouded Contacts

Closed Position Shrouded Contacts

Open Position Inductive Coils

Closed Position Inductive Coils

301 Modular upper receiver rail removed

302 Modular upper receiver rail installed

RIFLE ACCESSORY RAIL, COMMUNICATION, AND POWER TRANSFER SYSTEM—RAIL CONTACTS

CROSS-REFERENCE TO RELATED APPLICATIONS

This Patent Application claims the benefit of U.S. Provisional Patent Application Ser. No. 61/145,222, filed on Jan. 16, 2009. This application also is related to the US Patent Applications filed on the same date as the present application. Jan. 19. 2010. titled "Rifle Accessory Rail, Communication and Power Transfer System—Battery Pack", which is U.S. patent application Ser. No. 12/689,438; "Accessory Mount for Rifle Accessory Rail Communication and Power Transfer System—Accessory Attachment", which is U.S. patent application Ser. No. 12/689,436; "Rifle Accessory Rail, Communication, and Power Transfer System", which is U.S. patent application Ser. No. 12/689,430, "Rifle Accessory Rail Communication and Power Transfer System—Communication", which is U.S. patent application Ser. No. 12/689,437; and "Rifle Accessory Rail Communication and Power Transfer System—Power Distribution", which is U.S. patent application Ser. No. 12/689,439, and incorporating the disclosures therein.

BACKGROUND OF THE INVENTION

The present invention is related to weapons systems. In particular, the present invention is directed to accessory attachment systems for rifles and small arms weapons that enable attached accessory devices to draw power from a central power source and communicate with the user and/or other devices.

The current rifles and small arm weaponry in use by US armed forces can be equipped with numerous combat optics, laser designators/sights, and flashlights; all comes with different power requirements and battery supplies. The result is a heavy weapon and a heavier field load of batteries to accommodate the various accessories, which ultimately impacts the soldiers' effectiveness, particularly on longer missions. One of the US Army focus areas is improving the performance of their warfighters' combat equipment while reducing the load that each warfighter has to carry. One of these efforts is concentrated on providing advanced technologies to demonstrate the feasibility of an innovative communications rail and power transfer system. The resulting system will be backwards compatible with current mission support devices and accessories that mount to small arms weapons during operational procedures and it will reduce the overall weight penalties of the current system.

SUMMARY OF THE INVENTION

The present invention is directed to accessory attachment systems for rifles and small arms weapons that enable attached accessory devices to draw power from a central power source and communicate with the user and/or other devices.

It is an object of the present invention to obviate or mitigate at least one disadvantage of previous firearm accessory rails.

In a first embodiment of the present invention, there is provided a firearm accessory mounting rail for attachment of a firearm accessory to the barrel of a firearm. The accessory rail may provide a connection for the firearm accessory.

The present invention embodies firearm systems comprising at least one mounting rail comprising at least one power connection, at least one power source, at least one rail accessory comprising a rail grabber or mount, wherein the at least one rail accessory receives electrical power from the power source.

Another embodiment of the present invention provides an accessory attachment system for rifles and small arms weapons that enables attached accessory devices to draw power from a central power source and communicate with the user or other devices without exposed wires.

Other aspects and features of the present invention will become apparent to those ordinarily skilled in the art upon review of the following description of specific embodiments of the invention in conjunction with the accompanying figures.

DETAILED DESCRIPTION OF THE INVENTION

Figure 1A:
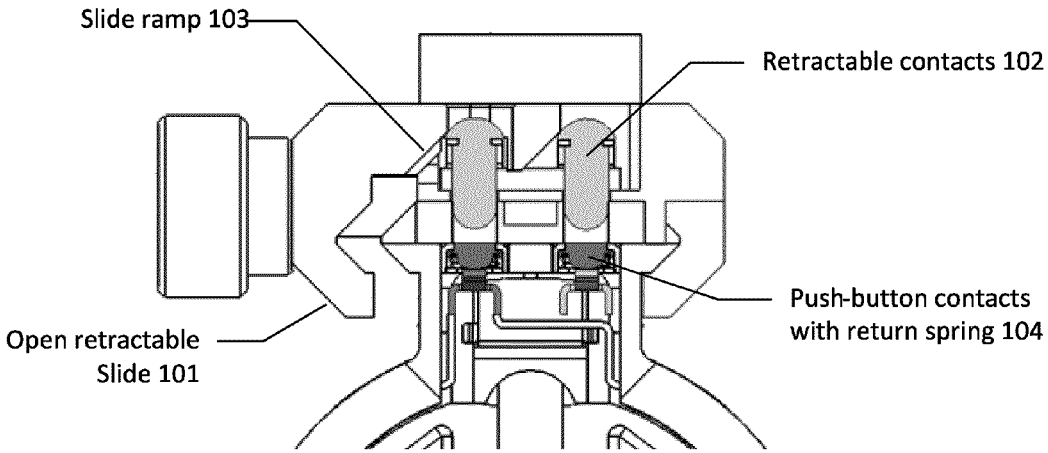
FIG. 1A shows an embodiment utilizing exposed switches or dome spring electrical contacts.
Figure 1A:
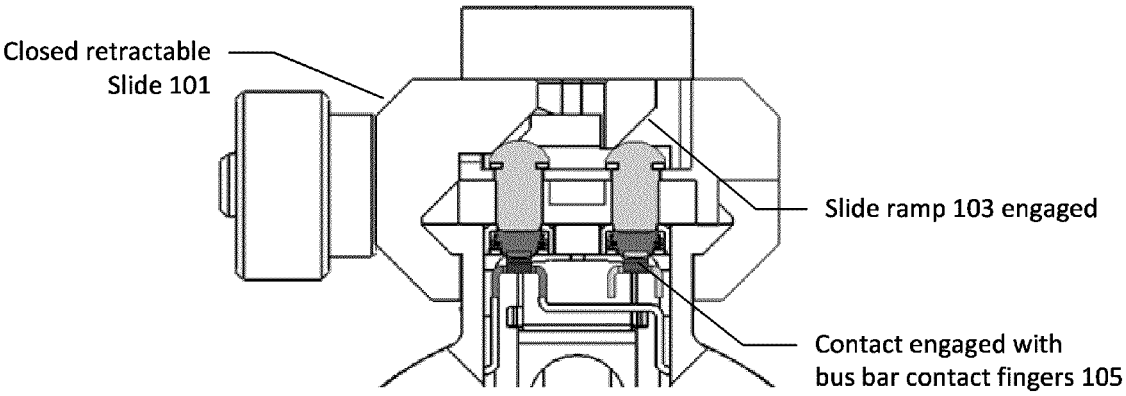

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implicated in other compositions and methods, and that any such variation would be within such modifications that do not part from the scope of the present invention. Before explaining the disclosed embodiments of the present invention in detail, it is to be understood that the invention is not limited in its application to the details of any particular embodiment shown, since of course the invention is capable of other embodiments. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein.

The main challenge is to demonstrate feasibility of a power and communication distribution system that would perform to meet the rigors of battle while maintaining the modularity of the weapon. This would require a system that is not affected by the environment, which is not complicated, and does not require tools to use. The design approach was to use an integrated power and communication system using an alternating current (for an inductive coil system) or direct current (for galvanic contact system) bus to the Picatinny Rails. The rail design has been modified to keep the same modularity without compromising the structural and functional aspects of the design while providing a conduit and connection point for the power and communications.

There are 4 contact mechanism designs between the rail and the accessories:

1. Galvanic contact via switch or dome spring contacts which are exposed in the grooves of the rail. These contacts are only live when a rail grabber is installed, depressing the switch contact and closing the circuit. The switch contact terminal comprises an array of normally off position contacts and the contact plate which actuates the terminal to make electrical contact. Removing the contact plate will allow the switch contact to spring back to a normally open position. The switch contact terminals are housed in a rugged sealed housing and mounted on a fully encapsulated circuit board. This method of contact is demonstrated in FIG. 1A.
2. Galvanic contact via a tapered pin that pierces a rubber covering over an energized bus bar. In this manner, the bus bar is protected from environmental contamination, and penetrations in the rubber seals are kept to a minimum. This method of contact is demonstrated in FIG. 1B.
3. Galvanic contact via a conventional pin contact which passes through a seal with a pre-molded lip that closes when the pin is removed. This method of contact is shown in FIG. 1C.
4. Wireless power transfer using Inductive coupling technology. Inductive coupling refers to the transfer of energy from one circuit component to another through a shared magnetic field. A change in current flow through one device induces current flow in the other device. The two devices may be physically contained in a single unit, as in the primary and secondary sides of a transformer, or may be separated as in the antenna on a transmitter and a receiver. Coupling may be intentional or unintentional. Unintentional coupling is called cross-talk, and is a form of interference. Using intelligent inductive power technology overcomes historic limitations of inductive coupling by using resonance-seeking circuitry that dynamically seeks and optimizes power transfer under multiple, varying load conditions and spatial configurations. Conventional inductive coupling typically requires careful "tuning" of the power supply circuit with the device being powered. Only minor variations in the physical positioning and power requirements of the inductively powered devices are tolerated. Any variation in either the load or the positioning of the power supply relative to the device can severely impact performance. This method of contact is shown if FIG. 2.

The inductive coupling technology includes an intelligent feedback and control system, communicating with individual devices in real time, which allows the technology to determine not only power needs, but also factors such as age of a battery or device and charging lifecycles on an individual basis in order to supply the optimal amount of power to keep a device at peak efficiency. For example, in an accessory rail application, a primary coil could be embedded into the mounting rail and the secondary coil could be embedded in the accessory's rail grabber. This would facilitate wireless power transfer and the ability to attach or remove various accessories to the rail system. This capability can be utilized to produce a very robust and flexible power distribution system for equipment operated in harsh environments. The technology is robust and could be effectively integrated with modern weapon systems to lighten the warfighters' load.

The devices that attach to the weapons use the MIL-STD-1913 rail. The current attachment rail can hold devices such as spotlights and flashlights, laser pointers, reflex optics, night vision systems, and other devices, each with unique power requirements that require soldiers to carry multiple batteries for each accessory. The innovation of the communication and power transfer system resides in the ability to power multiple devices (with different power requirements) from a single source, while maintaining the standard attachment modularity of existing devices and reducing the soldier's load by eliminating the need for multiple batteries.

A non-powered accessory rail profile is modified by milling a slot along its length; then a power buss is constructed taking electricity from a centralized location and distributing it to electrical contacts located along the milled slot, such that accessories can pick up power when attached to the rail.

Based on the intended application, corrosion resistance, chemical contaminant resistance, operating temperature ranges, humidity resistance, rain resistance, mud, ice and abrasion resistance are achieved by selecting appropriate contact materials and covering the PCB, switch contacts and associated circuitry with a suitable flexible cover, sealed to the rail.

Resistance to the effects of submersion is accomplished by switching power from the power buss to the accessory contacts. Rail power is only applied to the accessory contacts when the accessory is actually attached to the rail.

Polarity protection is achieved by using a non-symmetrical switch and contact arrangement. When the accessory is installed correctly, its actuating plunger depresses a switch, which then supplies power to the switched contact. If the accessory is installed on the rail backwards, the actuating plunger misses the switch and no power flows to the switched contact.

While the invention can be applied to any accessory rail, the primary application of this invention is intended to apply to the MIL-STD-1913 non-powered weapon accessory rail, commonly referred to in the commercial, law enforcement and sportsman market as a "Picatinny Rail" and by NATO countries as the STANAG 4694 NATO Accessory Rail. Our invention modifies this rail configuration by applying power from a central location to electrical rail contacts in such a way that rail accessories can use it instead of, or in conjunction with, their internal accessory power.

The design allows for rapid and reliable mating and unmating of power sources and power loads without concerns for protecting un-mated electrical contacts from adverse environmental conditions.

For applications requiring submersion in water, it is necessary to keep power from flowing to the accessory contacts to prevent electrical conductance through the water, which would electrolyze the water, as well as prematurely drain the common power source. Our invention accomplishes this by switching the positive power buss with environmentally protected switches such that no power flows until the rail accessory is attached to the rail.

FIGS. 1A, 1B, 1C, and 2 show optional, non-preferred embodiments of the rail contact.

FIG. 1A provides a drawing showing a retracting mounting slide (101) that mounts the accessory to the weapon rail. Electrical power is transferred to the accessory by contacts (102). Once the contacts have been moved by slide ramp (103), they engage the rail mounted power contacts (104) and bus bar contact fingers (105).

Figure 1B:
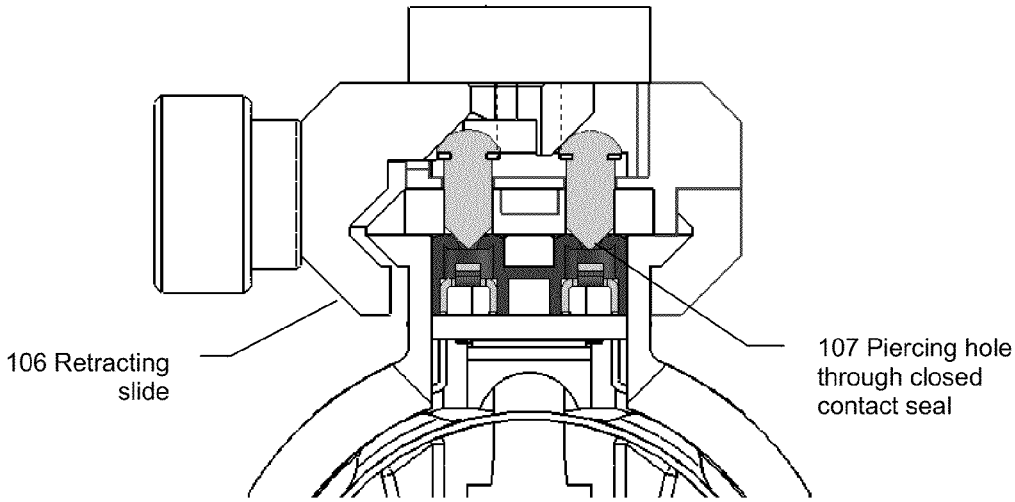
FIG. 1B shows an embodiment utilizing electrical contact pins that pierce a protective polymer.
Figure 1B:
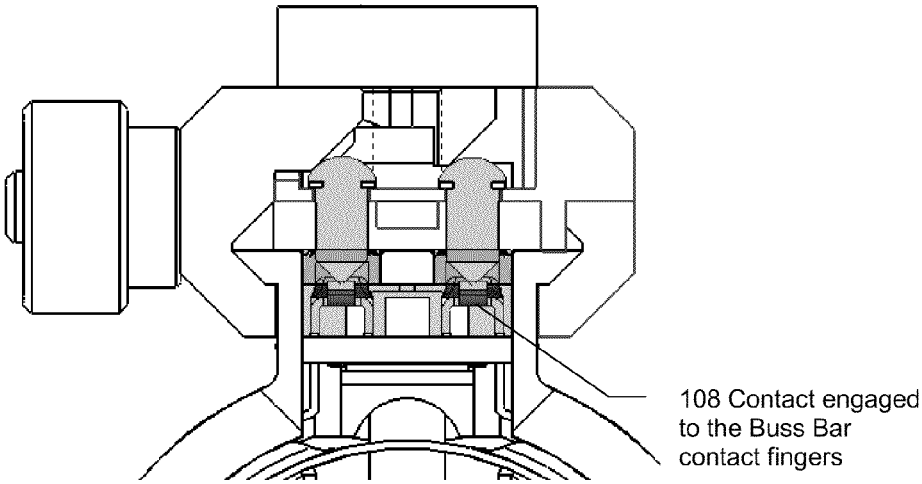
Figure 1C:
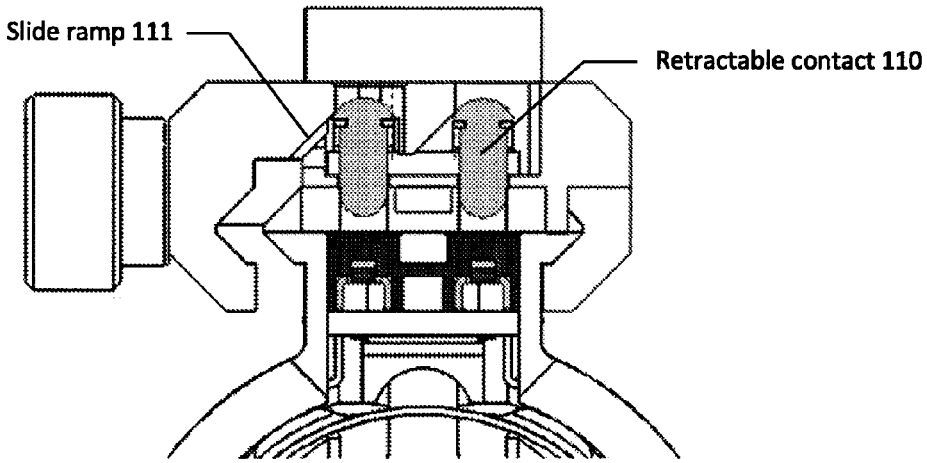
FIG. 1C shows an embodiment utilizing electrical contact pins that pass through a pre-molded elastomer lip.
Figure 1C:
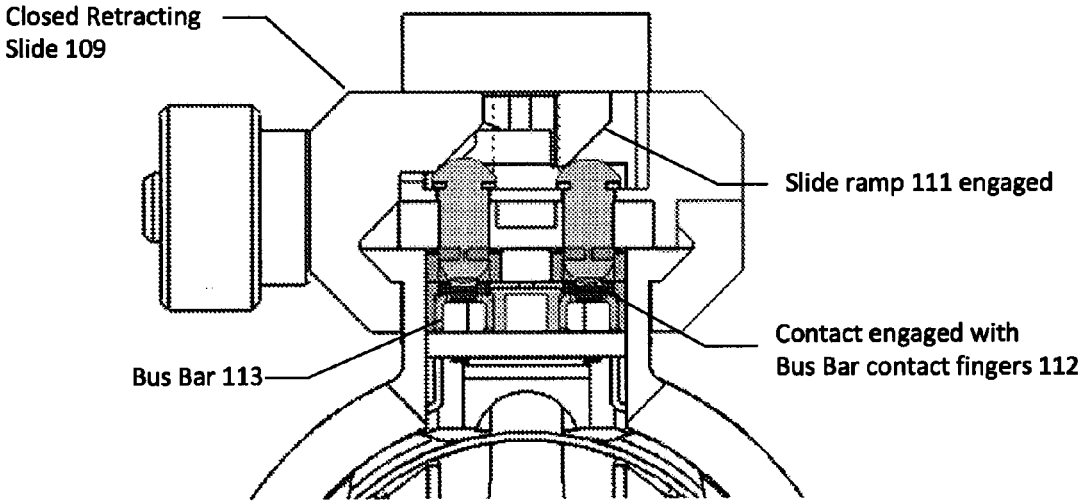

FIG. 1B provides a drawing showing a retracting mounting slide (106) that mounts the accessory to the weapon rail. Electrical power is transferred to the accessory by contacts piercing a non-conductive elastomer (107). Once the contacts have pierced the elastomer they engage the rail mounted power contacts (108).

FIG. 1C provides a drawing showing a retracting mounting slide (109) that mounts the accessory to the weapon rail. Electrical power is transferred to the accessory by contacts (110). Once the contacts have been acted upon by slide ramp (111) they engage the rail mounted power contacts (112) on bus bar (113).

Figure 2:
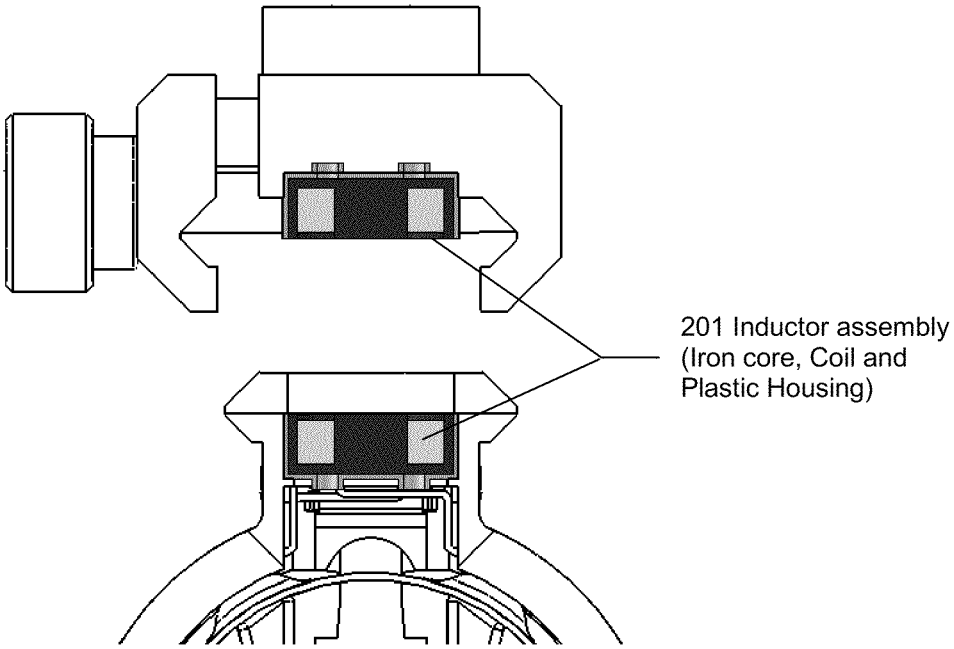
FIG. 2 shows an embodiment utilizing an inductively coupled power transfer arrangement.
Figure 2:
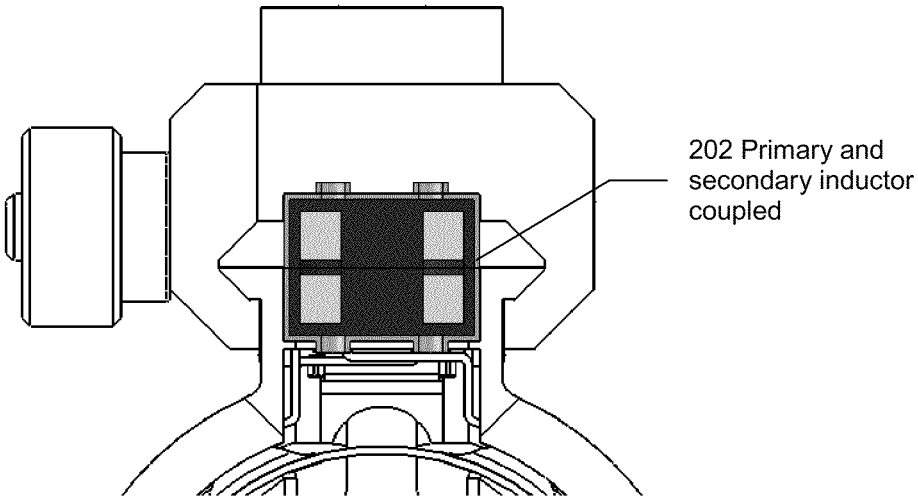

FIG. 2 shows two halves of a non-mated inductive power coupling arrangement (201). When the two halves are brought into close proximity alternating current is passed from the powered rail to the accessory (202).

Figure 3:
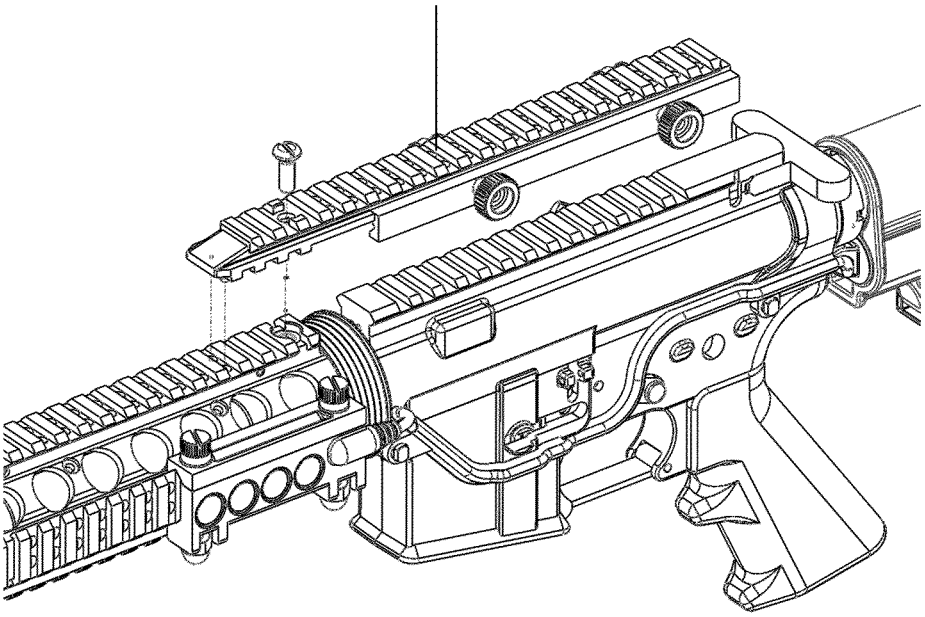
FIG. 3 shows an embodiment whereby a powered rail extension can be mounted to the main weapon receiver.
Figure 3:
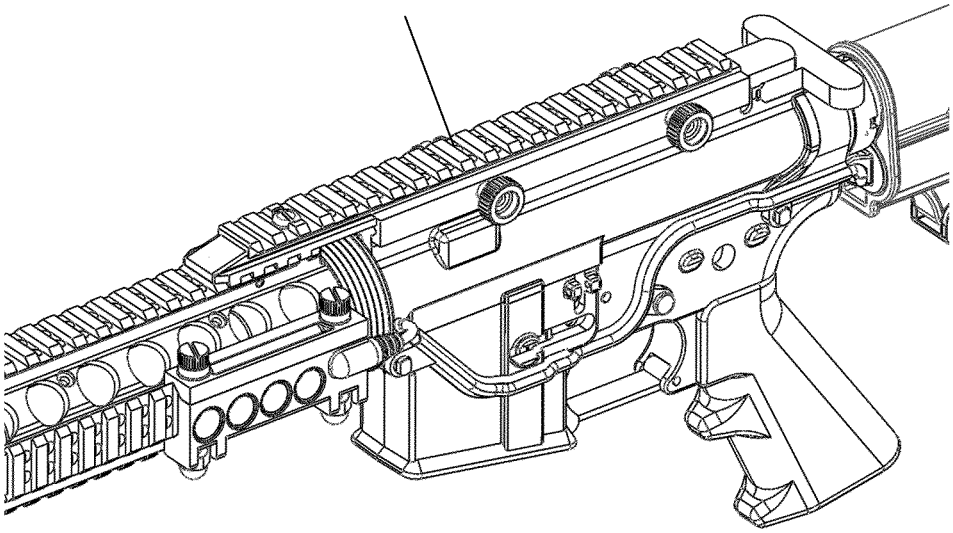

FIG. 3 shows an embodiment whereby a modular receiver rail (301) can be coupled to the main foregrip powered rail and attached to the main rifle receiver (302).

Figure 4:
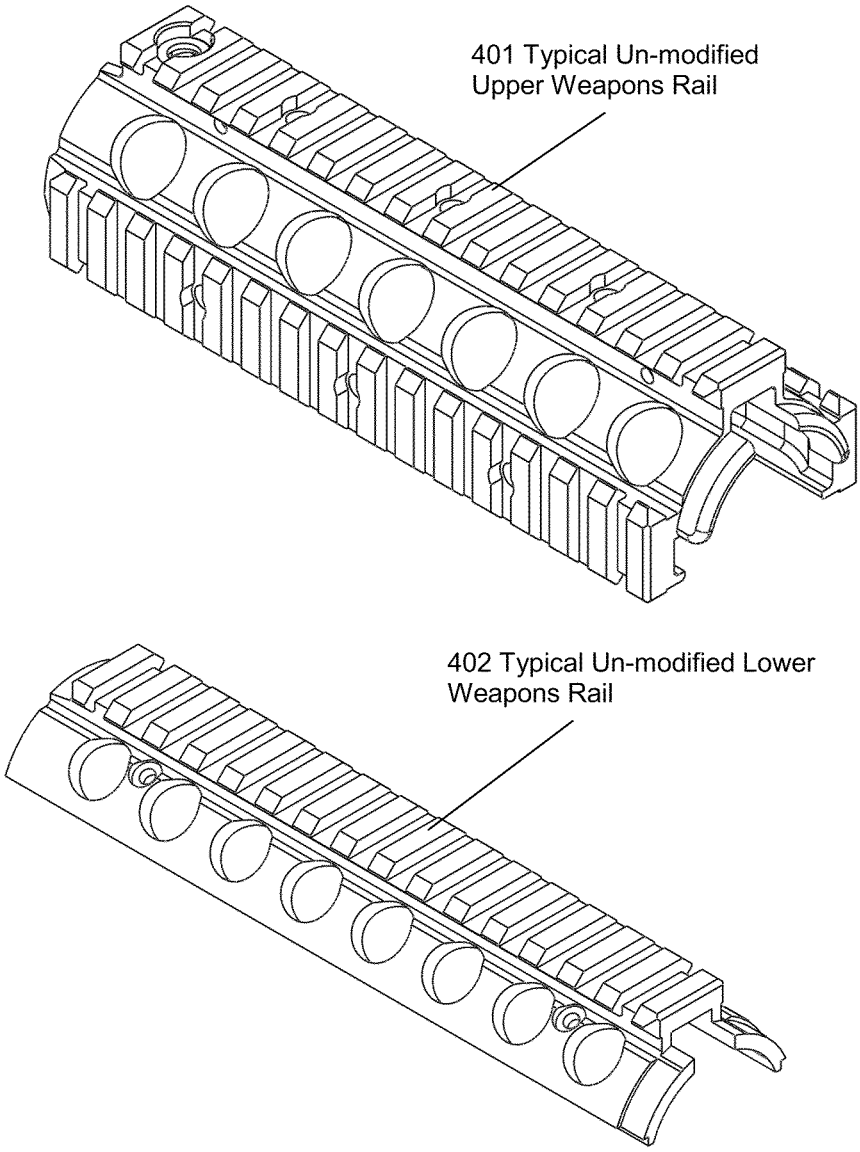
FIG. 4 shows a typical un-modified, non-powered upper and lower weapon rail.

FIG. 4 illustrates a typical commercially available, unmodified, non-powered, upper weapons rail (401) and a matching un-modified, non-powered, lower weapons rail (402). This configuration can form the basis for our preferred embodiment, namely a ruggedized power distribution PCB, etched and constructed in such a way as to pass power from a remote power source onto the rail, through switching contacts and on to modified powered rail mounted accessories.

Figure 5:
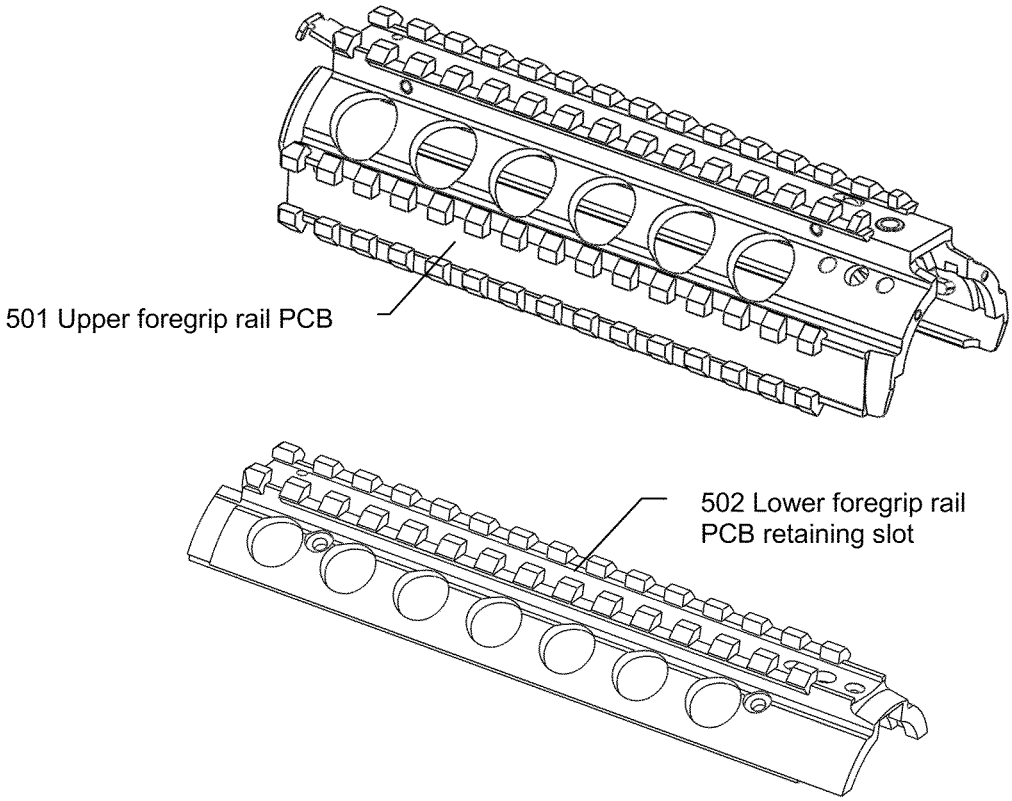
FIG. 5 shows a modification to a typical non-powered upper and lower weapon rail.

FIG. 5 shows a modification to a commercially available non-powered weapons rail. The modification involves milling slots along the length of the mechanical accessory attachment points in the upper foregrip (501) and the lower foregrip (502) in order to install one or more power distribution PCBs.

Figure 6:
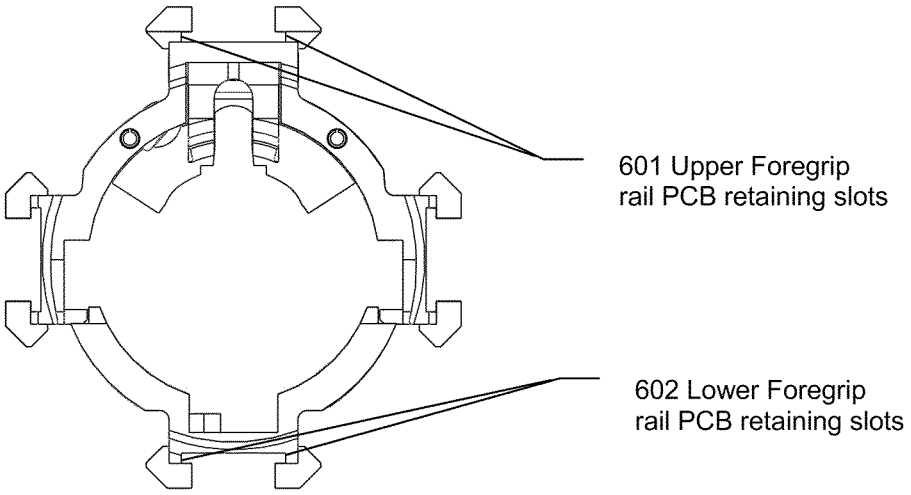
FIG. 6 shows an end view of a modification to a typical combined upper and lower non-powered weapon rail.

FIG. 6 shows an end view of the aforementioned slots in the upper foregrip (601) and the lower foregrip (602).

Figure 7:
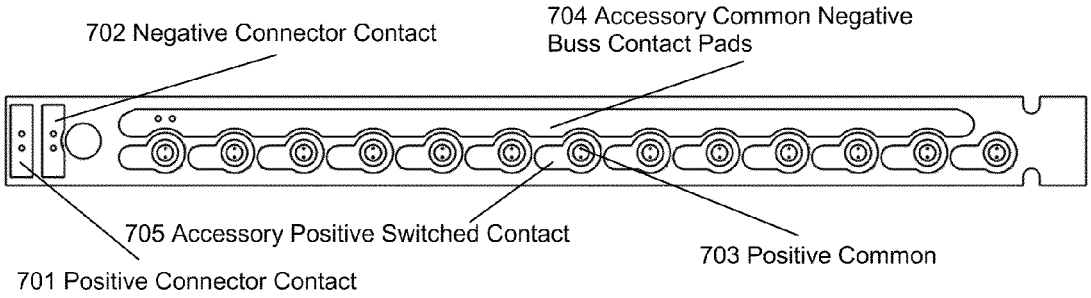
FIG. 7 shows a Printed Circuit Board (PCB) that passes electrical power from a common power source to rail mounted accessories.

FIG. 7 shows the detailed operation of the power distribution PCB. Remote power is applied via the positive connector contact (701) and the negative connector contact (702). This power is routed via the normal method of electrical traces on the PCB. The positive current from (701) is routed to common buss that reaches the surface of the PCB in the center of a PCB pad (703). The negative current from (702) is routed via electrical traces to the accessory common negative buss contact pads (704). Mounted accessories pick up negative current from the negative buss contact pads (704) and positive current from the positive switched contacts (705). The switching action is accomplished through the use of a metallic snap dome switch that spans (703) and (705).

Figure 8:
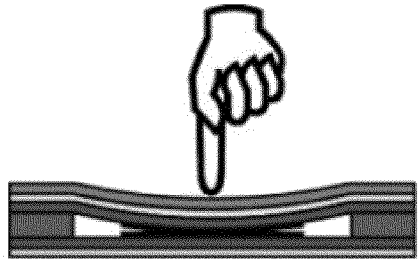
FIG. 8 details the operation of a metallic snap dome switch which is used on the rail mounted power transfer PCB.

FIG. 8 shows the common use of a metallic snap dome switch, which is a commercially available component well known to those versed in the art of manufacturing keyboards and keypads and is shown here as an aid to understanding the operation of the switching function on the power distribution PCB. A curved metallic dome is positioned such that it spans two conductors. When the dome is depressed in the direction shown by the hand icon, the dome "snaps" downward such that it electrically bridges the two conductors, thus providing an electrical path between them.

Figure 9:
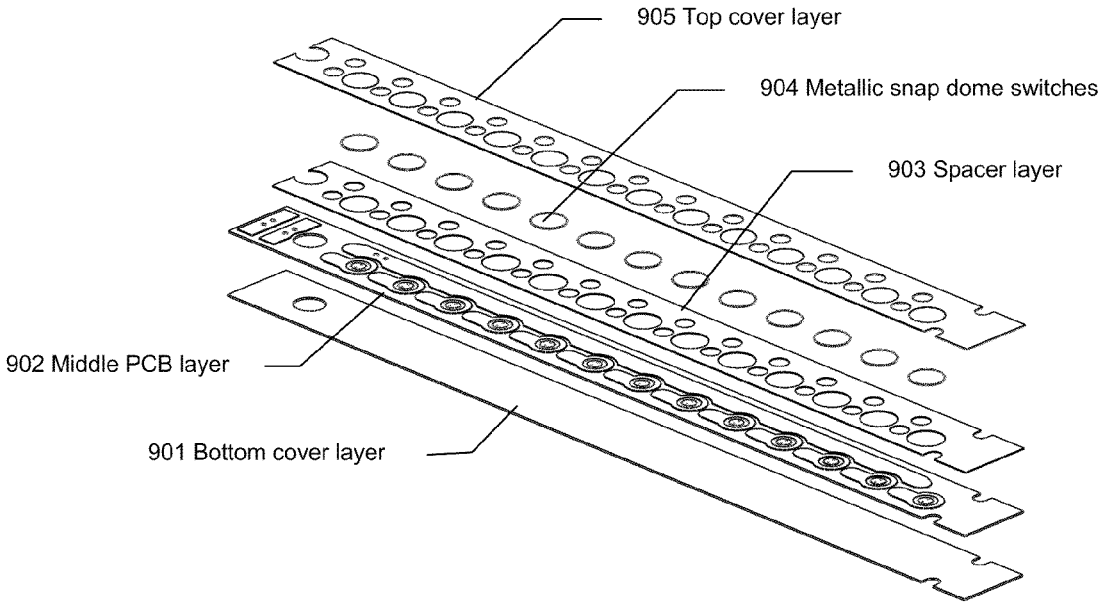
FIG. 9 shows an exploded detail view of our power transfer PCB and its component parts.

FIG. 9 shows an exploded view of the power distribution PCB assembly. Starting from the bottom, a non-conductive layer (901) prevents the metal weapon rail from electrically shorting the power distribution PCB (902). The power distribution PCB (902) distributes remote, switched power to rail mounted accessories as previously explained. Spacer layer (903) is a non-conductive component that holds the metallic snap dome switches in place such that they do not move laterally when the layers are assembled into a cohesive unit. Metallic snap dome switches (904) provide the electrical switching action to mounted rail accessories as previously described. The top cover layer (905) provides environmental protection to the PCB (902) and the metallic snap dome switches (904) when the layers are assembled into a finished unit.

Figure 10:
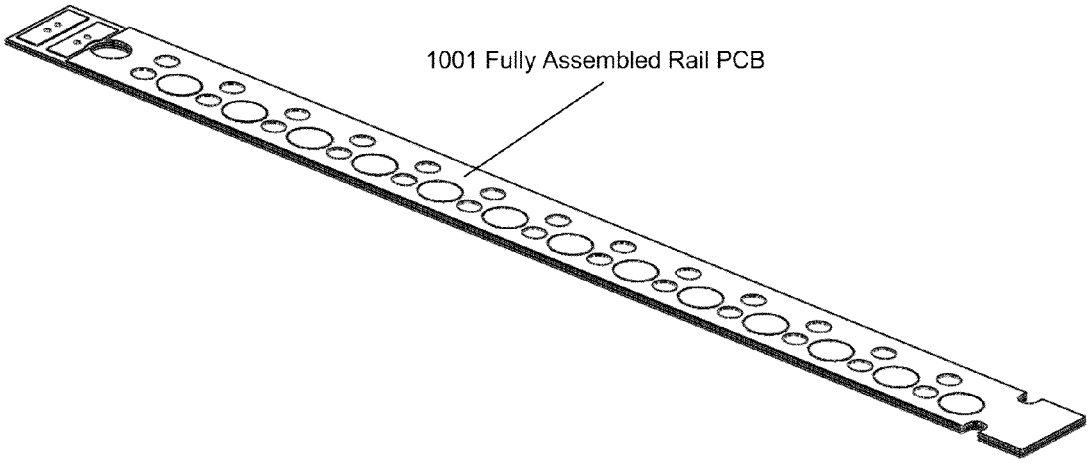
FIG. 10 shows a completely assembled power transfer PCB that is used in the powered rail system.

FIG. 10 shows the power distribution PCB (1001) completely assembled into a finished unit, ready to be mounted into a modified weapon rail.

Figure 11:
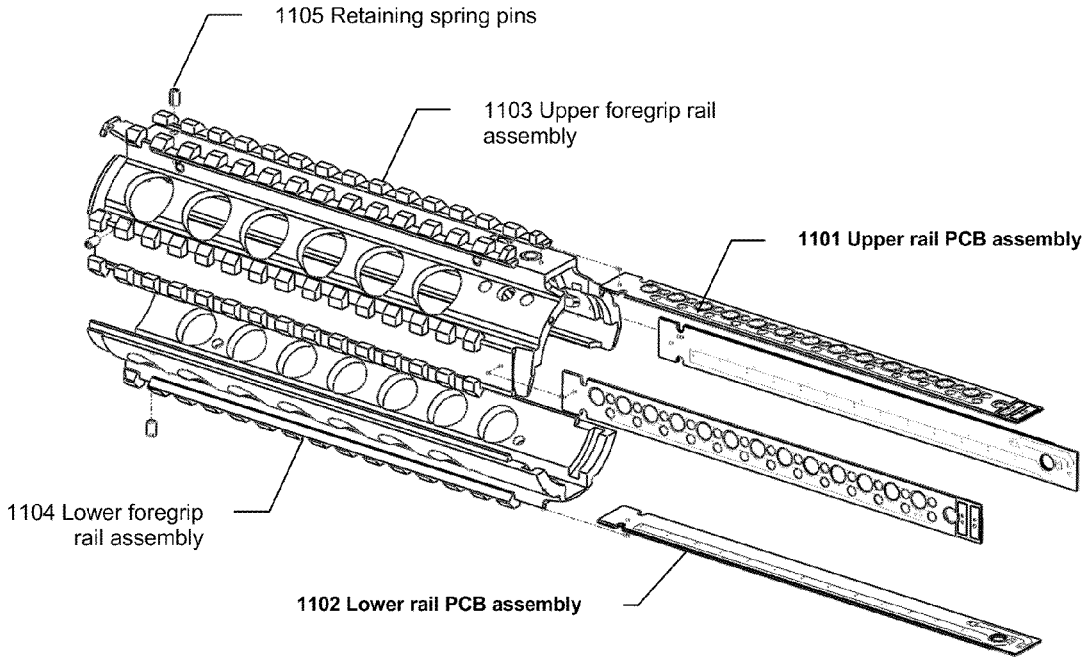
FIG. 11 shows an exploded view of the modified weapon rails receiving the PCB's.

FIG. 11 shows an upper rail power distribution PCB assembly (1101) and a lower rail power distribution PCB assembly (1102) ready to slide into the upper foregrip rail assembly (1103) and the lower foregrip rail assembly (1102), respectively. All of the power distribution PCB assemblies are retained linearly by inserting retaining spring pins (1105) through slots in the power distribution PCB assemblies into holes drilled into the upper and lower foregrip rail assemblies.

Figure 12:
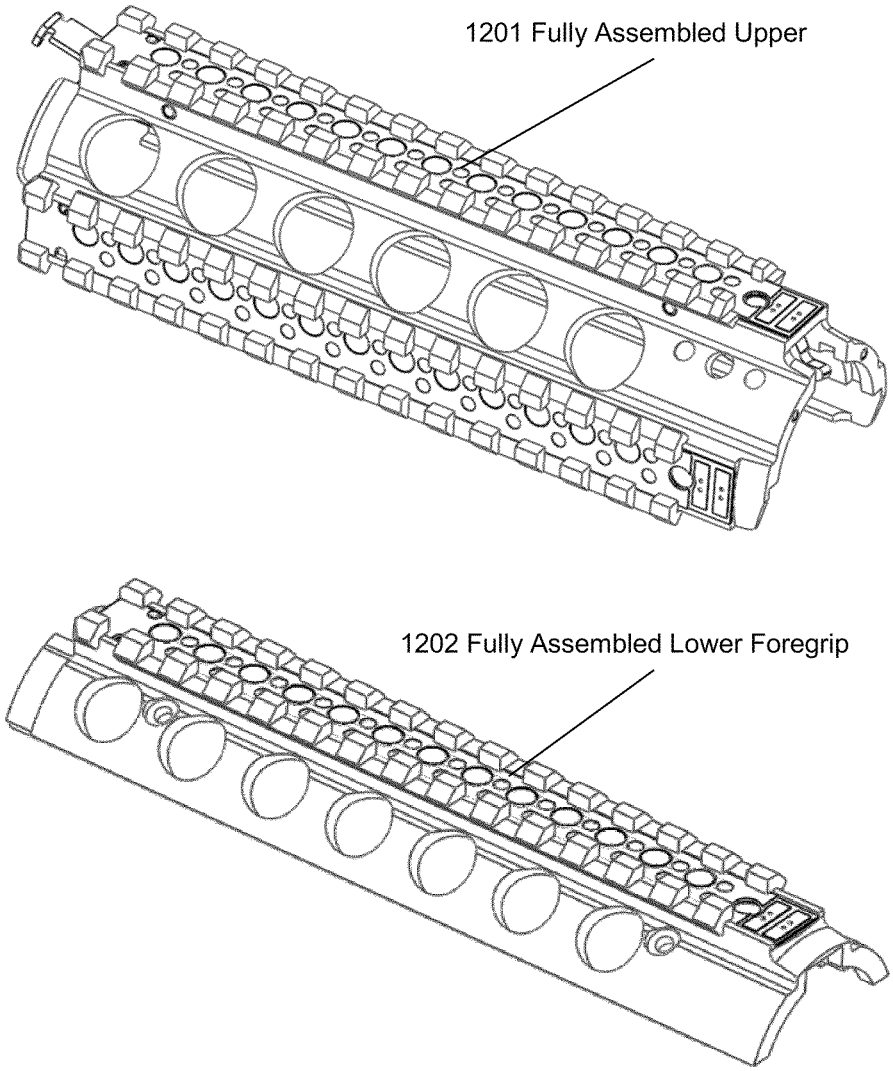
FIG. 12 shows a fully assembled upper and lower foregrip, comprised of the modified weapon rails and the power transfer PCB.

FIG. 12 shows a fully assembled upper foregrip powered rail assembly (1201) and a fully assembled lower foregrip powered rail assembly (1202), ready to be mounted to a weapon.

Figure 13:
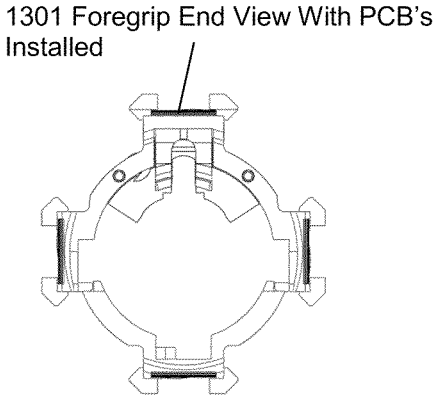
FIG. 13 shows an end view of the power transfer PCB's installed into the modified weapon rails.

FIG. 13 shows an end view of the upper and lower foregrip powered rail assemblies configured as a single unit (1301) as they would normally be when attached to a weapon.

Figure 14:
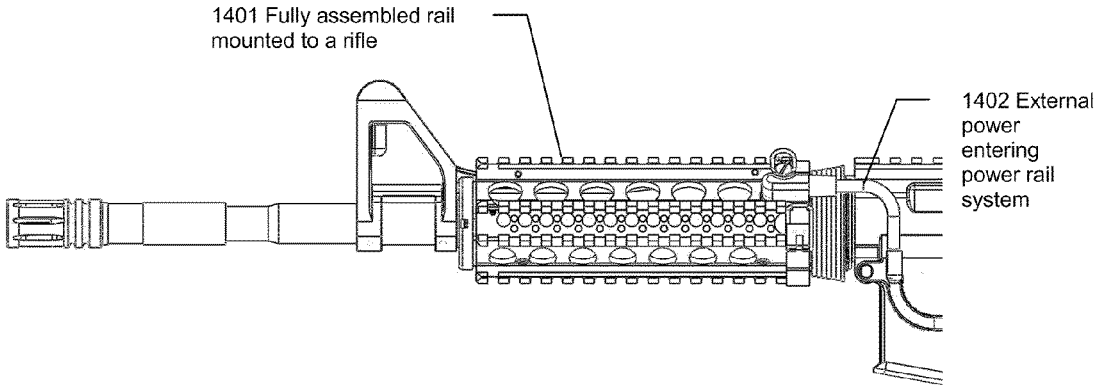
FIG. 14 shows the powered rail system attached to a typical military rifle, receiving power through a shrouded power cable.

FIG. 14 shows a fully assembled powered rail unit (1401) mounted to a typical rifle and powered externally by a shrouded electrical cable (1402). In this configuration, power is supplied by a remote power source, transferred through (1402), into (1401) and is ready to be used by rail mounted accessories.

Figure 15:
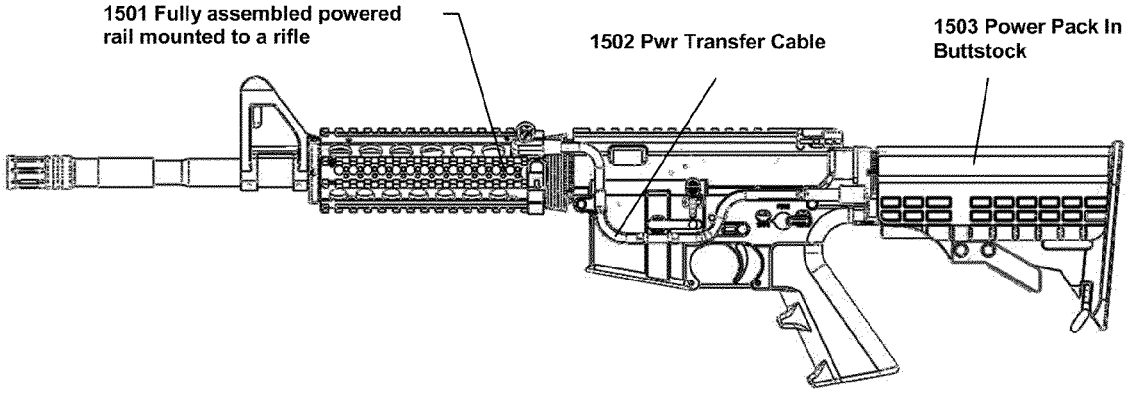
FIG. 15 shows the powered rail system attached to a typical military rifle, receiving power through a shrouded power cable, powered by a common power source located within the rifle buttstock.

FIG. 15 shows a fully assembled powered rail unit (1501) mounted to a typical rifle. Power for the unit is routed through a shrouded power cable (1502), which receives its power from a battery pack mounted in the rifle's buttstock (1503). In this configuration, the rifle is now a complete and unified power source for powered accessories mounted to any of the powered rails of the powered rail unit (1501).

Figure 16:
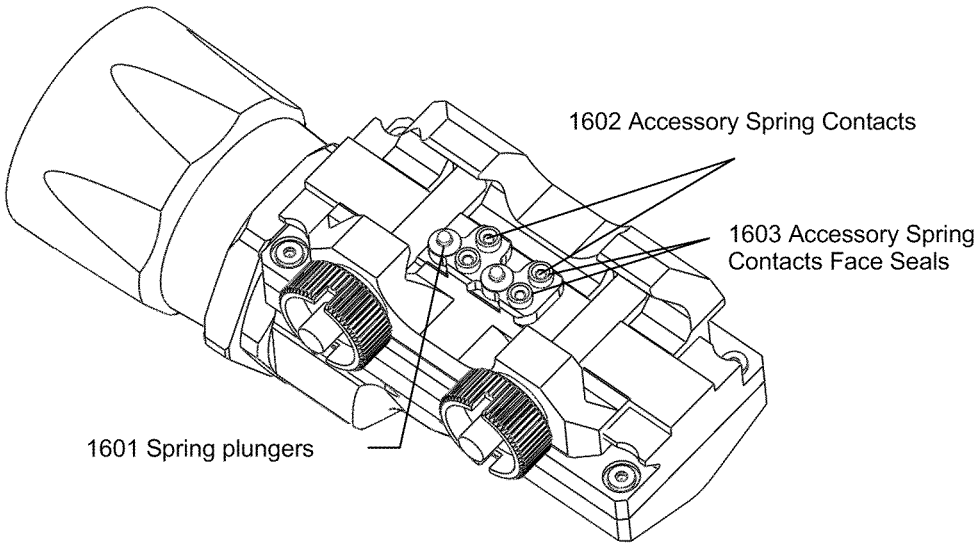
FIG. 16 illustrates an accessory power pickup mounted in a weapon rail attachment device.

FIG. 16 shows a modified accessory rail connection that allows the accessory to be powered from the aforementioned powered rail unit. When the accessory is mechanically attached to the powered rail, a spring plunger (1601) depresses the aforementioned metallic snap dome switch, which completes an electrical path to the aforementioned accessory positive switched contact in FIG. 7 (705). Power is then transferred to the accessory spring contacts (1602) and the accessory is made electrically active. Environmental sealing for the accessory spring contacts (1602) is provided by elastomer accessory spring contact face seals (1603).

Figure 17:
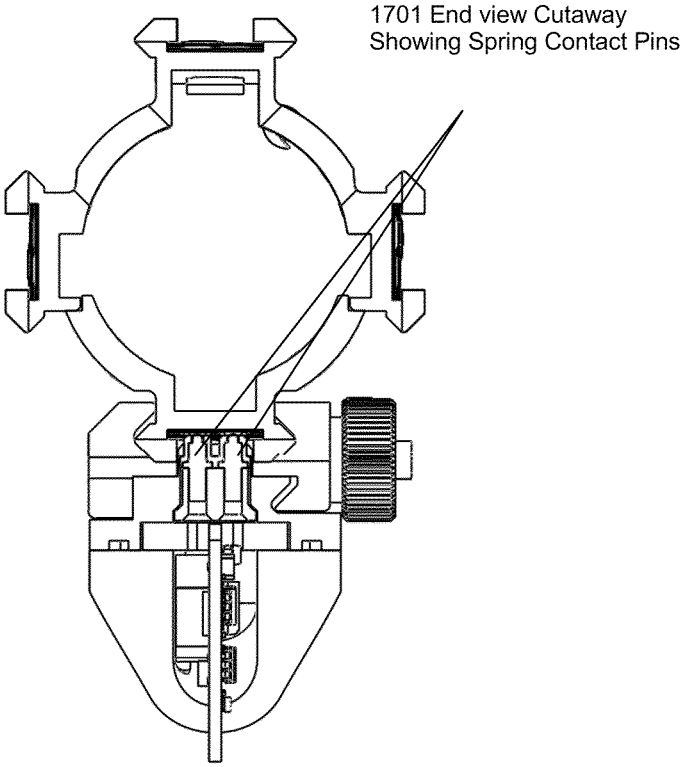
FIG. 17 shows a cutaway end view detailing the spring contact pins of an accessory power pickup mounted to the powered rail.

FIG. 17 is a cutaway view of a powered rail accessory attached to a powered rail unit, showing the accessories spring contact pins (1701) that pick up electrical power from the powered rail PCB when the accessory is mechanically mounted to the rail.

Figure 18:
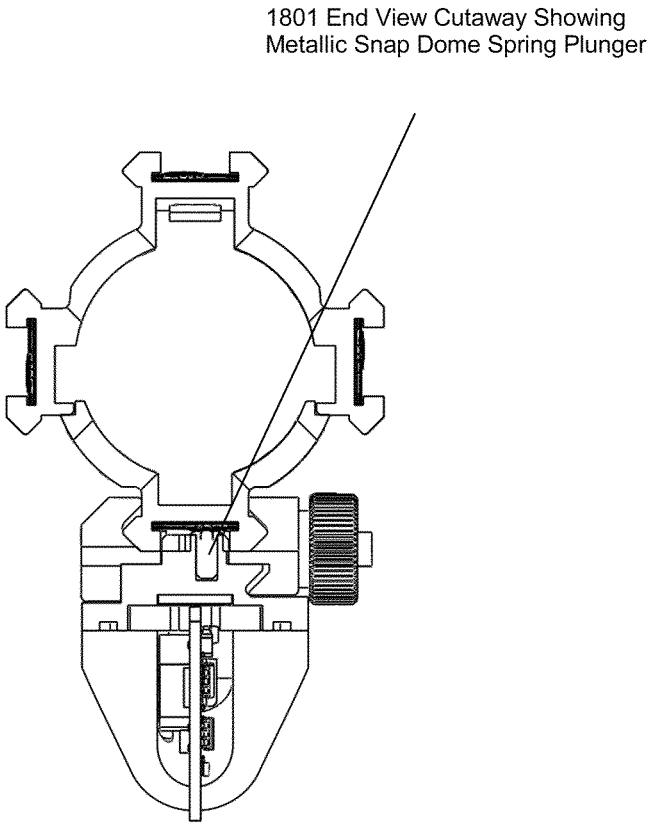
FIG. 18 shows a cutaway end view detailing the metallic snap dome spring plunger on an accessory power pickup mounted to the powered rail.

FIG. 18 is a cutaway view of a powered rail accessory attached to a powered rail unit, showing the accessories metallic snap dome plunger (1801) which depresses the aforementioned metallic snap dome switch on the powered rail PCB as shown in FIG. 9 (904), with the result that the accessory positive switched contact shown in FIG. 7 (705) is activated and passes current to the accessory.

Figure 19:
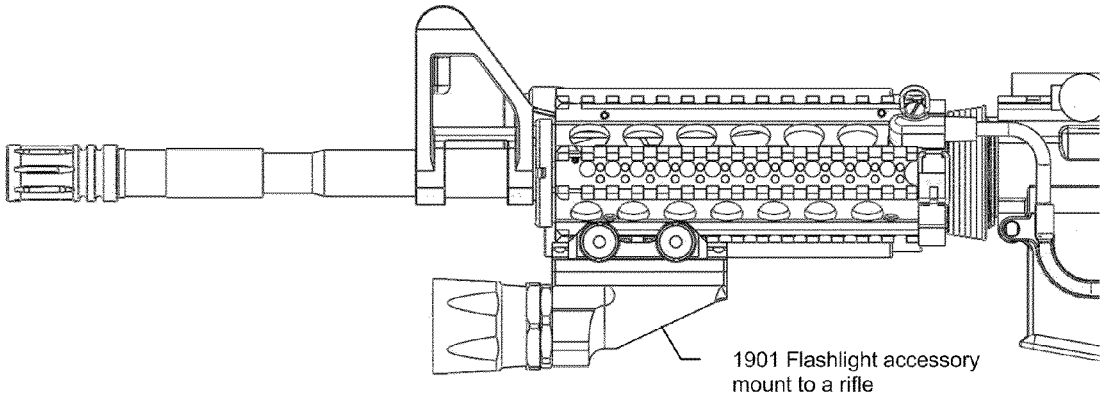
FIG. 19 shows a complete flashlight accessory mounted to and receiving power from, the powered rail.

FIG. 19 shows a modified powered flashlight accessory (1901) mounted to the powered rail unit and fully functional. In this example, the flashlight is picking up electrical power in the manner previously described and is physically mounted to the rail with standard rail mount hardware. While this illustration shows the light on the foremost part of the bottom rail, it can of course be mounted in any position of any powered rail, due to the multiple contact pads and switches.

Figure 20:
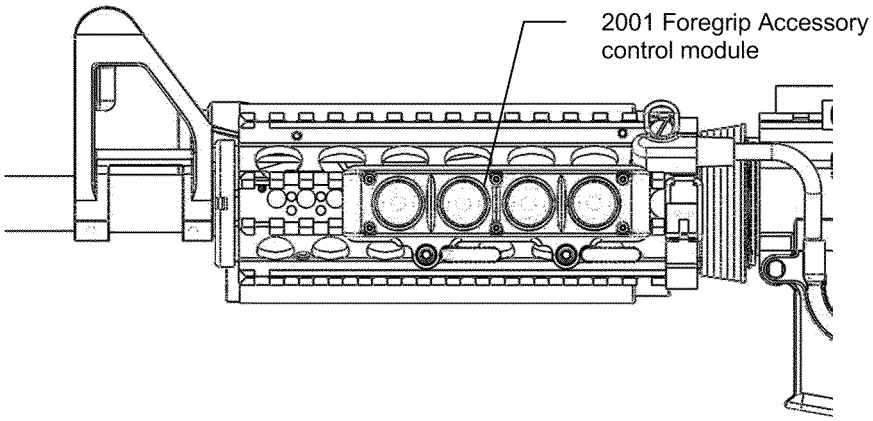
FIG. 20 shows a fully functional optional horizontal accessory control module.

FIG. 20 shows a fully functional, optional horizontal (2001) accessory control module that has the ability to pass command and control signals over the powered rail in order to activate and de-activate mounted accessories, as well as provide accessory identification and status. This module is not required to use the powered rail, but it may optionally be used as described above.

Figure 21:
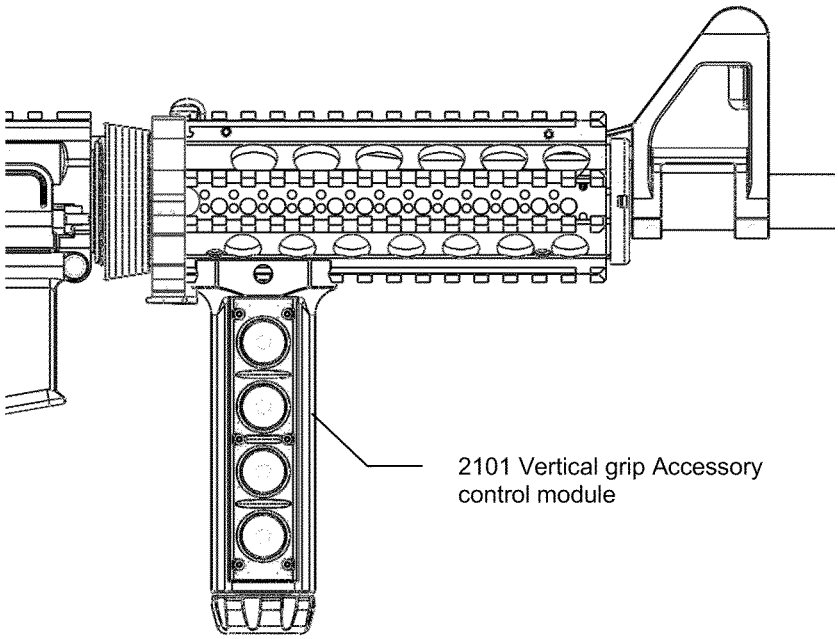
FIG. 21 shows a fully functional optional vertical accessory control module.

FIG. 21 shows a vertical grip, accessory control module that has the ability to pass command and control signals over the powered rail in order to activate and de-activate mounted accessories, as well as provide accessory identification and status. This module is not required to use the powered rail, but it may optionally be used as described above.

What is claimed is:

1. A Weapons Accessory Power Distribution and Communication System for providing a supply of electrical power for use by one or more power-consuming accessories operatively associated with a weapon, the Weapons Accessory Power Distribution and Communication System comprising:

a power source;

a power-consuming accessory; and a powered rail extending along at least a portion of a length of a barrel of a weapon, and electrically connected to the power source, wherein the powered rail comprises:

a plurality of mechanical features formed on the outer surface of the powered rail in a parallel, spaced-apart relationship for mechanically positioning the power-consuming accessory, a first electrical contact and a second electrical contact positioned between at least two of the mechanical features for providing a first and a second electrical connection to the power source, respectively, a mechanically activated electrical switch located on the powered rail, wherein a first contact of the electrical switch is electrically connected to the power source, and a second contact of the electrical switch is electrically connected to the first electrical contact, wherein the second electrical contact is electrically connected to the power source; and wherein mechanical mounting of a power-consuming accessory between the two mechanical features electrically connects the power-consuming accessory to the first and the second electrical contacts, while also mechanically activating the electrical switch to conduct electrical power from the first contact of the electrical switch to the second contact of the electrical switch.

2. The Weapons Accessory Power Distribution and Communication System of claim 1 wherein the power-consuming accessory first and second electrical contacts comprise:

first and second contacts extending from a bottom surface of the power-consuming accessory to engage corresponding dome spring contacts for completing the first and second electrical connections to the power source in response to the power-consuming accessory being mounted on the powered rail.

3. The Weapons Accessory Power Distribution and Communication System of claim 1 wherein the power-consuming accessory first and second electrical contacts comprise:

first and second contacts extending from a bottom surface of the power-consuming accessory to engage corresponding covered contacts for completing the first and second electrical connections to power source in response to the power-consuming accessory being mounted on the powered rail.

4. The Weapons Accessory Power Distribution and Communication System of claim 1 wherein the power-consuming accessory first and second electrical contacts comprise:

terminals of an inductive coupling circuit to wirelessly receive power from a corresponding inductive coupling power source mounted on the powered rail and positioned under the power-consuming accessory.

5. The Weapons Accessory Power Distribution and Communication System of claim 1 wherein the power source comprises:

a battery mounted inside of a buttstock of the weapon.

6. The Weapons Accessory Power Distribution and Communication System of claim 1 wherein mounting the power-consuming accessory on the powered rail simultaneously mechanically secures the power-consuming accessory to the powered rail and electrically interconnects two electrical contacts on the power-consuming accessory to the first and second electrical contacts and simultaneously contacts to electrically connect the first electrical contact of the insulative backplane.

* * * * *